United States Patent [19]

Anderson

[11] 4,363,190

[45] Dec. 14, 1982

[54] PIVOTED SASH WINDOW SASH GUIDE AND BALANCE LOCK STRUCTURE

[75] Inventor: Richard N. Anderson, Owensboro, Ky.

[73] Assignee: V. E. Anderson Mfg. Company, Owensboro, Ky.

[21] Appl. No.: 50,816

[22] Filed: Jun. 21, 1979

[51] Int. Cl.[3] ..... E05D 15/22

[52] U.S. Cl. ..... 49/181; 49/446; 49/453

[58] Field of Search ..... 49/181, 446, 453

[56] References Cited

U.S. PATENT DOCUMENTS

| | | | |
|---|---|---|---|
| 3,055,062 | 9/1962 | Peters et al. | 49/181 X |
| 3,108,335 | 10/1963 | Osten, Sr. | 49/181 X |
| 3,434,237 | 3/1969 | Love | 49/181 |
| 3,482,354 | 12/1969 | Trout | 49/446 X |
| 3,959,926 | 6/1976 | Noecker et al. | 49/181 |

*Primary Examiner*—Philip C. Kannan
*Attorney, Agent, or Firm*—Whittemore, Hulbert & Belknap

[57] ABSTRACT

Sash guide and balance lock structure in pivoted window structure, which window structure includes an elongated hollow jamb member having a slot in one side thereof and an adjacent pivoted window sash, which sash guide and balance lock structure comprises a pivot shoe positioned within the jamb member for reciprocal movement therewithin having an opening therethrough aligned with the slot in the jamb member and including resilient tab portions extending centrally from the rear side of the pivot shoe and toward the bottom thereof, on each side of the opening terminating in cam portions, and a cylinder cam including a cylindrical shank having an axially extending non-circular opening therein extending through the opening in the pivot shoe and a flat head having a resilient periphery on the cylindrical shank having notches in opposite portions. Said pivot shoe and cylinder cam being constructed and arranged so that on pivotal movement of the cylinder cam relative to the pivot shoe the head of the cylinder cam moves behind the tab portions of the pivot shoe to expand the pivot shoe to resiliently force the tab portions into engagement with the rear wall of the jamb member and to face the opposite side of the pivot shoe into engagement with the jamb member at each side of the slot. A non-circular actuating member is secured to the window sash and inserted within the non-circular opening in the cylinder cam shank for pivoting the cylinder cam relative to the pivot shoe on pivoting of the window sash with respect to the jamb member.

14 Claims, 8 Drawing Figures

PIVOTED SASH WINDOW SASH GUIDE AND BALANCE LOCK STRUCTURE

BACKGROUND OF THE INVENTION

1. Field of the Invention

The invention relates to window structures including a frame and a window sash movable in the plane of the window structure between frame jamb members and which may be pivoted out of the plane of the window structure, and refers more specifically to unique sash guide and balance lock structure for use in such pivoted sash window structure including a pivot shoe movable within a jamb member and a cylinder cam carried by the pivot shoe and engaged with the window sash for expanding the pivot shoe into resilient locking engagement with the jamb member on pivoting of the window sash with respect to the jamb member.

2. Description of the Prior Art

In the past, sash guide and balance lock structure, including pivot shoes and cylinder cams used to pivotally support a window sash in assembly with a jamb member while engaged with a sash balance, have either operated to cam the pivot shoe and cylinder cam away from each other whereby the separate members engage either the front and rear walls or the opposite side walls of a jamb member to lock the sash guide and balance lock structure in position on tilting of the sash or one of the pivot shoe and cylinder cam have acted directly against the jamb member to force the other of the pivot shoe and cylinder cam into locking engagement with the jamb member.

Such prior sash guide and balance lock structures have usually been deficient in that the locking force has usually increased with increased pivoting of the window sash.

Also, the locking pressure between the sash guide and balance lock structures of the past and the associated window structure has usually been provided by substantially rigid parts of the sash guide and balance lock structures whereby the locking pressure is not resiliently applied.

Also, prior sash guide and balance lock structures have often included a member integral with actuating means therefor secured to the window sash whereby disengagement of the pivot shoe from the cylinder cam of the sash guide and balance lock structure was possible on lateral movement of the window sash.

Further, the sash guide and balance lock structures of the past have often been complicated and therefore expensive to produce and inefficient in operation.

SUMMARY OF THE INVENTION

The invention is in sash guide and balance lock structure in pivoted sash window structure. The sash guide and balance lock structure of the invention includes a pivot shoe and a cylinder cam cooperable to guide a pivotally mounted window sash in movement within the plane of the window structure between jamb members and to lock the pivot axis of the window sash in a fixed position along the jamb members on pivoting of the window sash out of the plane of the window structure.

The pivot shoe of the sash guide and balance lock structure includes a body portion which is generally rectangular and includes guide pads at the four corners thereof for guiding the pivot shoe in reciprocal movement within a jamb member of the window structure, which jamb member has a generally rectangular cross section and an elongated slot in one side thereof. The body portion of the sash guide and balance lock structure includes an upper part having means to facilitate attaching a sash balance thereto and a lower part including an opening extending therethrough positioned to be in alignment with the slot in the jamb member. Said pivot shoe also including a pair of resilient tab portions extending outwardly from one side of the body portion of the pivot shoe centrally thereof and terminating toward the bottom of the pivot shoe in caming portions extending toward the body portion of the pivot shoe.

The cylinder cam of the sash guide and balance lock structure has a cylindrical shank with a non-circular recess in one end thereof which extends through the opening in the pivot shoe, and a flat circular head at the other end of the cylindrical shank with opposed notches in the periphery thereof.

In assembly, the shank of the cylinder cam is positioned within the opening in the pivot shoe and the head thereof is positioned between the tab and body portions of the pivot shoe, whereby on rotation of the cylinder cam relative to the pivot shoe, the head of the cylinder cam engages the cam parts of the tab portions of the pivot shoe to cam the tab portions of the pivot shoe into engagement with the rear wall of the jamb member of the window structure and force the body portion of the pivot shoe into engagement with the wall of the jamb member on each side of the slot therein.

A separate non-circular actuating bar is secured to the pivoted window sash of the window structure and is engaged with the cylinder cam to rotate the cylinder cam relative to the pivot shoe on pivoting on the pivoted window sash with respect to the jamb member.

In accordance with the invention, the cylinder cam may be assembled with the pivot shoe by inserting the shank of the cylinder cam in the opening through the pivot shoe with the head of the cylinder cam oriented so that the tab portions of the pivot shoe pass through the notches in the head of the cylinder cam, after which the cylinder cam is rotated 180° with respect to the pivot shoe to secure the pivot shoe in assembled relation with respect to the pivot shoe with parts of the head of the cylinder cam adjacent the notches in the periphery thereof between the tab and body portions of the pivot shoe.

The cylinder cam and pivot shoe are constructed of plastic and the tab portions of the pivot shoe and the head of the cylinder cam are resilient, whereby on pivoting of the cylinder cam relative to the pivot shoe, the force with which the tabs and body member of the pivot shoe are caused to engage the walls of the jamb member is known and remains substantially constant over a considerable pivot angle of the window sash.

DESCRIPTION OF THE PREFERRED EMBODIMENT

Pivoted sash window structure is known per se and is shown for example in U.S. Pat. No. 4,028,849, the disclosure of which patent is incorporated herein by reference.

Figure 1:
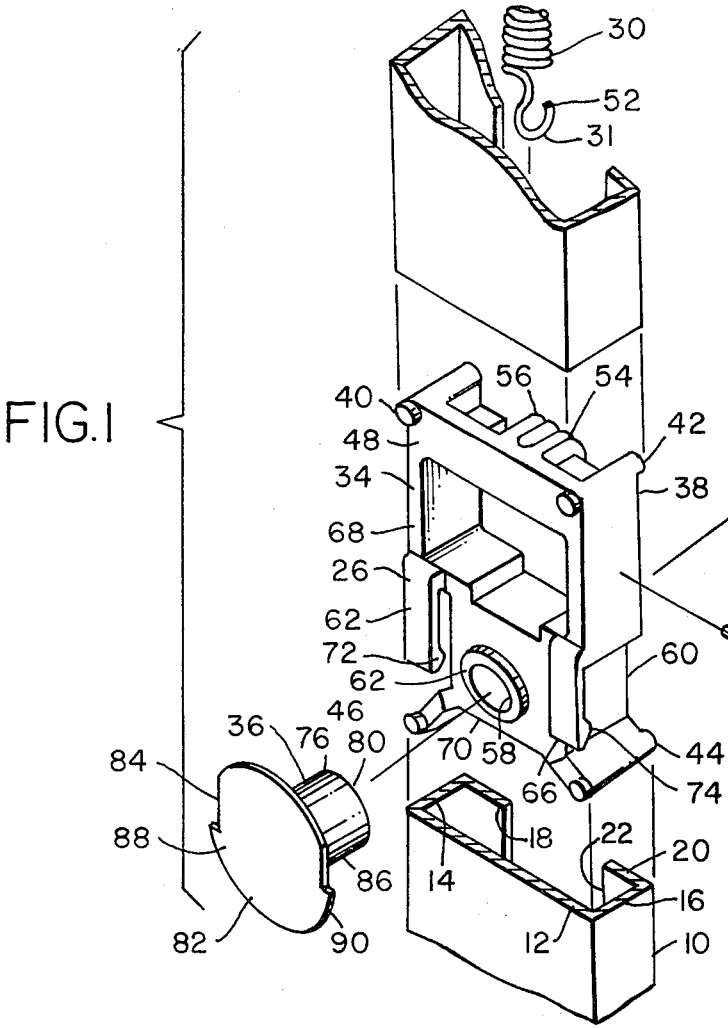
FIG. 1 is an exploded view of a portion of pivoted sash window structure having unique sash guide and balance lock structure constructed in accordance with the invention.
Figure 3:
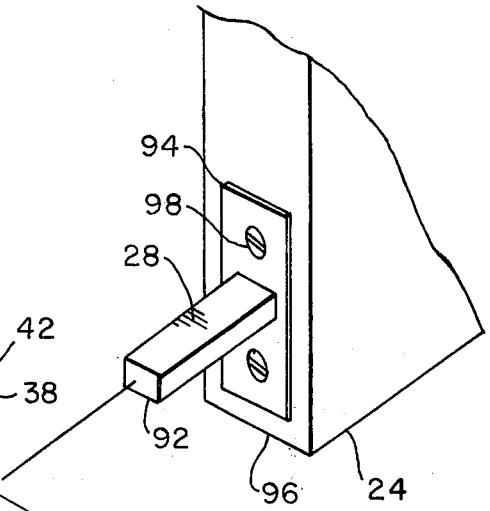
FIG. 3 is an enlarged end view of the cylinder cam member of the invention, taken substantially in the direction of arrow 3 in FIG. 4.

Such pivoted sash window structures as the invention is concerned with each include a jamb member 10, as shown best in FIG. 1, which may be either a window frame jamb member or a jamb liner. In either case, the jamb member 10, in accordance with the invention, will be an elongated hollow member and will provide a generally rectangular cross section as shown in FIG. 1 including a rear wall 12, side walls 14 and 16 and front wall flanges 18 and 20. The front wall flanges 18 and 20 will be separated by the longitudinally extending slot 22.

The window structure will further include a pivoted sash 24, the lower corner of which is shown in FIG. 1. The jamb members 10 will be provided at both sides of the pivoted sash 24 and separate sash guide and balance lock structure 26 will be provided in conjunction with the jamb members 10 and pivoted sash 24 at both sides of the window structure in the usual manner along with actuating means 28 operable between the pivoted sash 24 and the sash guide and balance lock structure 26 at both sides of the window structure.

Figure 2:
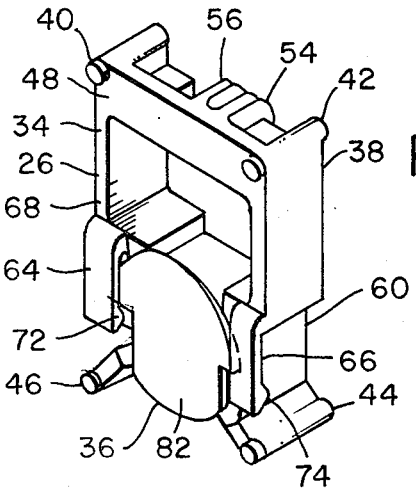
FIG. 2 is a perspective view of the sash guide and balance lock structure of the invention, with the pivot shoe and cylinder cam members thereof assembled.
Figure 4:
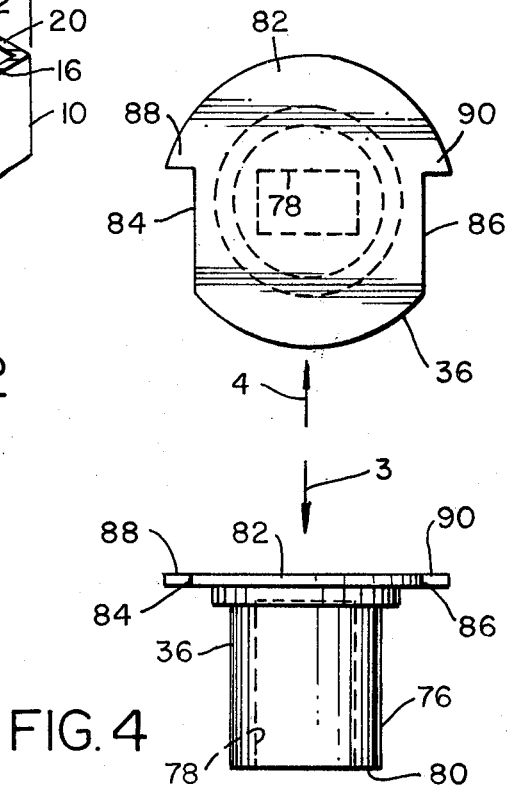
FIG. 4 is an elevation view of the cylinder cam illustrated in FIG. 3, taken in the direction of arrow 4 in FIG. 3.
Figure 5:
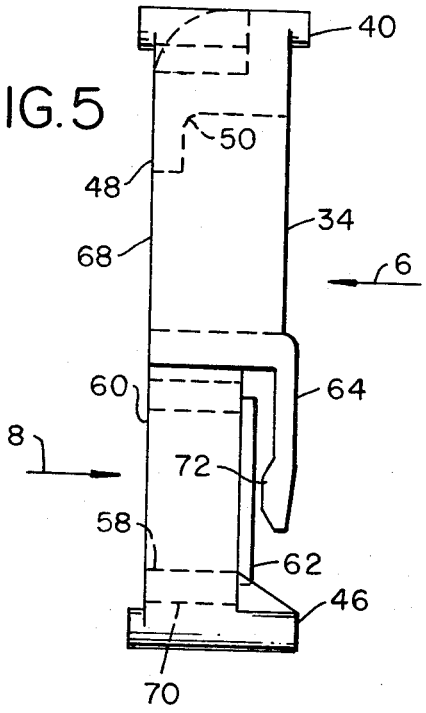
FIG. 5 is an enlarged side elevation view of the pivot shoe of the invention, taken in the direction of arrow 5 in FIG. 6.
Figure 6:
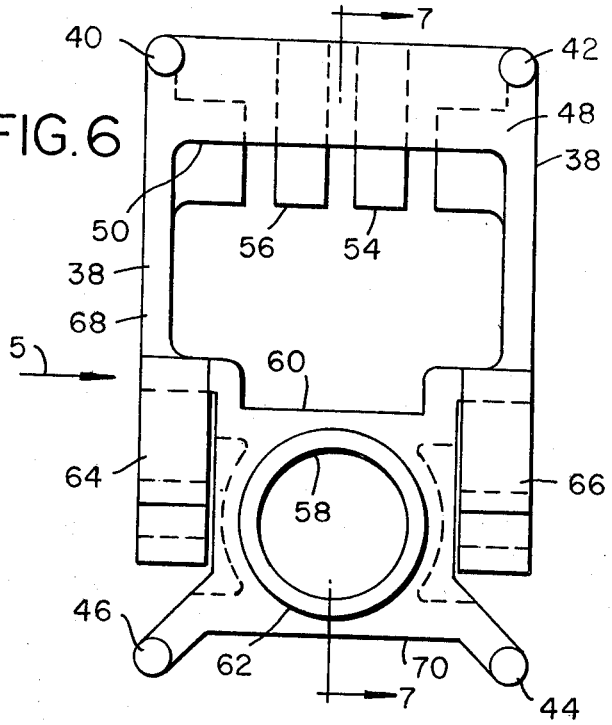
FIG. 6 is a rear view of the pivot shoe illustrated in FIG. 5, taken in the direction of arrow 6 in FIG. 5.
Figure 7:
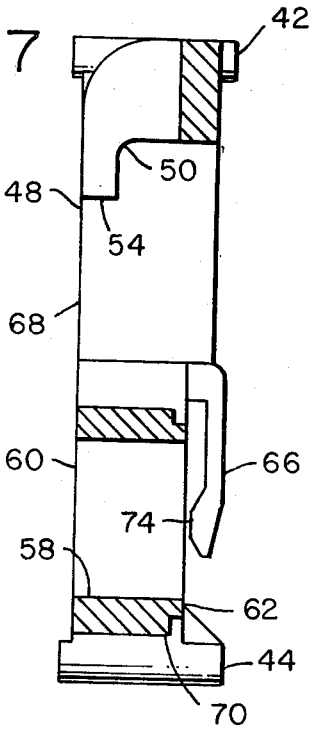
FIG. 7 is a section view of the pivot shoe illustrated in FIG. 6, taken substantially on the line 7—7 in FIG. 6.
Figure 8:
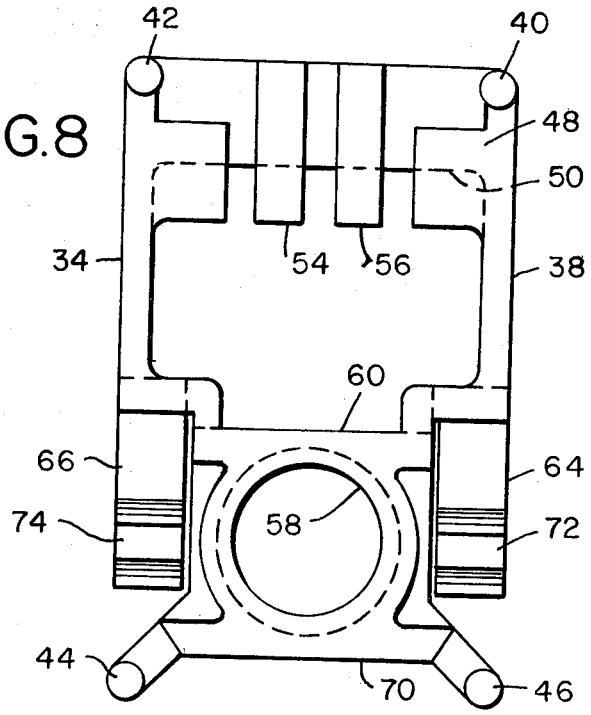
FIG. 8 is a front view of the pivot shoe illustrated in FIG. 5, taken in the direction of arrow 8 in FIG. 5.

Sash balance structure 30 is secured at one end 31 thereof to one or both of the sash guide and balance lock structures of a given window structure by convenient means such as a pin 32, shown in FIG. 2. The other end (not shown) of the sash balance structure 30 is connected to the jamb member 10 or other window structure at a remote location in the usual fashion. The sash balance structure shown is spring balance structure. However, any conventional balance structure as, for example, torsion band balance structure, may be used in conjunction with the sash guide and balance lock structure 26, if desired.

The sash guide and balance lock structure 26 includes a pivot shoe 34 and a cylinder cam 36.

The pivot shoe 34, as shown best in FIGS. 5–8, includes a generally rectangular body portion 38 having guide pads 40, 42, 44 and 46 at the corners thereof.

The upper part 48 of the body portion 38 of the pivot shoe 34 is constructed as shown in FIGS. 1, 2 and 5–8 to include a pocket 50 for receiving the pin 32. The hook portion 52 of the balance 30 extends between the fins 54 and 56 and around the pin 32 to secure the pin 32 in the pocket 50 and to secure end 31 of the balance structure 30 to the pivot shoe 34. The other end of the sash balance structure 30 is conventionally secured to the upper portion of the jamb member 10 or other window frame structure.

A cylindrical opening 58 extends through the lower part 60 of the body portion 38 of the pivot shoe 34. An annular ring 62 is provided about the rear edge of the opening 58. Opening 58 is provided to receive the shank of the cylinder cam 36, as will be considered subsequently.

The pivot shoe 34 further includes the tab portions 64 and 66 which extend from the rear side 68 of the body portion 38 substantially centrally thereof toward the bottom 70 of the pivot shoe 34. The tab portions 64 and 66 are terminated in cam parts 72 and 74 extending toward the body portion 38 of the pivot shoe 34, as shown.

The cylinder cam 36 includes a cylindrical shank 76 having a non-circular opening 78 in end 80 thereof. A flat circular cap 82 is provided on the other end of the shank 76. Opposed notches 84 and 86 are cut from the periphery of the head 82 of the cylinder cam 36 as shown to facilitate assembly of the cylinder cam 36 with the pivot shoe 34.

In assembly, the shank portion 76 of the cylinder cam 36 is axially inserted into the opening 58 from the rear side 68 of the pivot shoe with the head 82 of the cylinder cam 36 oriented as shown in FIG. 1. With such orientation of the head 82, the head 82 of the cylinder cam 36 will move past the tab portions 64 and 66 without interference. The cylinder cam is then locked into assembly with the pivot shoe 34 on rotation of the cylinder cam 36, 180° with respect to the pivot shoe 34 into the position shown in FIG. 2, wherein the portions 88 and 90 of the head 82 of the cylinder cam 36 adjacent the notches 84 and 86 have cammed over the camming part 72 or 74 of the tab portion 64 or 66, depending on which way the cylinder cam head was rotated into position behind the tab portions 64 and 66.

The thus assembled pivot shoe 34 and cylinder cam 36 are positioned in the jamb members 10 through one end thereof in the orientation shown in FIG. 1 with the opening 58 aligned with the slot 22. The balance 30 may then be attached to the pivot shoe 34 by convenient means such as the pin 32.

The actuating member 28, which as shown has a non-circular shaft portion 92 and a base 94, is rigidly secured to the lower corner 96 of the pivoted sash 24 by convenient means such as screws 98 or the like. Then, in assembly of the window sash 24 in the window structure, the non-circular shaft 92 is inserted in the complementary non-circular recess 78 in the cylinder cam 36.

In operation, on movement of the window 24 in a direction longitudinally of the jamb member 10, movement of the bottom corner 96 of the sash 24 is guided by the pivot shoe 34. On pivoting of the sash 24 about the bottom edge thereof, the cylinder cam 36 is caused to rotate relative to the pivot shoe 34 to cam the tabs 64 and 66 into engagement with the rear wall 12 of the jamb member 10 and to cam the body portion 38 of the pivot shoe 34 into engagement with the flanges 18 and 20 of the jamb member 10 whereby the pivot shoe 26 is expanded to lock into place in the jamb member 10 and fix the pivot axis of the pivoted sash 24.

On return of the pivoted sash 24 to the plane of the window, no camming force is provided against tabs 64 and 66 by the head 82 of the cylinder cam, and the side stile of the pivoted sash 24 is in alignment with the jamb member 10, so that movement of the window sash 24 along the jamb member 10 may be continued.

It will be noted that the head 82 of the cylinder cam 36 extends radially outwardly of the annular ring 62 so as to be cantilevered therefrom toward the tabs 64 and 66, which are in turn cantilevered from the rear side 68 of the body portion 38 of the pivot shoe 34. Both the head 82 of the cylinder cam 36 and the tab portions 64 and 66 of the pivot shoe 26 are resilient so that the locking of the pivot shoe to the jamb member 10 on pivoting of the window 24 is accomplished with a predetermined substantially uniform force over a large pivot angle.

While one embodiment of the present invention has been considered in detail, it will be understood that other embodiments and modifications thereof are contemplated by the inventor. It is the intention to include all embodiments and modifications as are defined by the appended claims within the scope of the invention.

I claim:

1. Window structure comprising at least one elongated jamb member including a rear wall, side walls and front wall flanges defining a generally rectangular hollow cross section with an elongated slot in the front wall thereof, a pivot shoe positioned within the recess for guided reciprocal movement therein longitudinally of the jamb member, a cylinder cam operably associated with the pivot shoe for expanding the pivot shoe into engagement with both the rear wall and front flanges of the jamb member on relative rotation of the cylinder cam and pivot shoe, said pivot shoe including a generally rectangular body portion having an upper part including means for securing a sash balance thereto and a lower part having a transverse opening therein for receiving the cylinder cam and tab portions extending from one side of the body portion and longitudinally of the jamb member in spaced relation to the bottom part of the body portion of the pivot shoe at the sides of the opening therein terminating in cam parts extending toward the body portion, a sash positioned adjacent the jamb member for pivotal movement relative to the jamb member, and actuating means secured to the window sash and engaged with the cylinder cam for producing rotation of the cylinder cam relative to the pivot shoe on pivoting of the window sash relative to the jamb member.

2. Structure as set forth in claim 1, wherein the cylinder cam and pivot shoe include engaged resilient portions whereby the pivot shoe is resiliently urged into locking engagement with the rear wall and front flanges of the jamb member on pivoting of the pivot shoe relative to the cylinder cam with a predetermined substantially constant force over a substantial pivot angle.

3. Structure as set forth in claim 1, wherein the cylinder cam includes a non-cylindrical recess therein and the actuating means includes a non-cylindrical shaft one end of which is inserted in the non-cylindrical recess in the cylinder cam and means at the other end of the non-cylindrical shaft for securing the non-cylindrical shaft to the window sash.

4. Windown structure comprising at least one elongated jamb member including a rear wall, side walls and front wall flanges defining a generally rectangular hollow cross section with an elongated slot in the front wall thereof, a pivot shoe positioned within the recess for guided reciprocal movement therein longitudinally of the jamb member, a cylinder cam operably associated with the pivot shoe for expanding the pivot shoe into engagement with both the rear wall and front flanges of the jamb member on relative rotation of the cylinder cam and pivot shoe, said cylinder cam including a cylindrical shank rotatably mounted in the pivot shoe, said cylindrical shank having a non-cylindrical axial opening in one end thereof, and a substantially flat head at the other end of the cylindrical shank having opposed notches in the periphery thereof, a sash positioned adjacent the jamb member for pivotal movement relative to the jamb member, and actuating means secured to the window sash and engaged with the cylinder cam for producing rotation of the cylinder cam relative to the pivot shoe on pivoting of the window sash relative to the jamb member.

5. Structure as set forth in claim 4, wherein the cylinder cam and pivot shoe include engaged resilient portions whereby the pivot shoe is resiliently urged into locking engagement with the rear wall and front flanges of the jamb member on pivoting of the pivot shoe relative to the cylinder cam with a predetermined substantially constant force over a substantial pivot angle.

6. Structure as set forth in claim 4, wherein the cylinder cam includes a non-cylindrical recess therein and the actuating means includes a non-cylindrical shaft one end of which is inserted in the non-cylindrical recess in the cylinder cam and means at the other end of the non-cylindrical shaft for securing the non-cylindrical shaft to the window sash.

7. Guide and lock structure for use with an elongated hollow member having an elongated slot located centrally of one side thereof having a rear wall, side walls and a front wall flange on each side of the slot comprising a pivot shoe adapted to be positioned within the elongated member for guided reciprocal movement therealong, a cylinder cam operably associated with the pivot shoe, said pivot shoe including a generally rectangular body portion having an upper part including means for securing a sash balance thereto and a lower part having a transverse opening therein for receiving the cylinder cam and tab portions extending from one side of the body portion and longitudinally of the jamb member in spaced relation to the bottom part of the body portion of the pivot shoe at the sides of the opening therein terminating in cam parts extending toward the body portion, said pivot shoe and cylinder cam including structure operable therebetween for expanding the pivot shoe into engagement with the rear wall and front flanges of the elongated member on relative pivotal movement between the pivot shoe and cylinder cam for locking the pivot shoe and cylinder cam in a selected position longitudinally of the elongated hollow member.

8. Structure as set forth in claim 7, wherein the structure operable between the cylinder cam and pivot shoe includes engaged resilient portions whereby the pivot shoe is resiliently urged into locking engagement with the rear wall and front flanges of the jamb member on pivoting of the pivot shoe relative to the cylinder cam with a predetermined substantially constant force over a substantial pivot angle.

9. Structure as set forth in claim 7, wherein the cylinder cam includes a non-cylindrical recess therein and further including actuating means for the guide and lock structure comprising a non-cylindrical shaft one end of which is inserted in the non-cylindrical recess in the cylinder cam and means at the other end of the non-cylindrical shaft for securing the non-cylindrical shaft to a window sash.

10. Guide and lock structure for use with an elongated hollow member having an elongated slot located centrally of one side thereof having a rear wall, side walls and a front wall flange on each side of the slot comprising a pivot shoe adapted to be positioned within the elongated member for guided reciprocal movement therealong, a cylinder cam operably associated with the pivot shoe, said cylinder cam including a cylindrical shank rotatably mounted in the pivot shoe, said cylindrical shank having a non-cylindrical axial opening in one end thereof, and a substantially flat head at the other end of the cylindrical shank having opposed notches in the periphery thereof, said pivot shoe and cylinder cam including structure operable therebetween for expanding the pivot shoe into engagement with the rear wall and front flanges of the elongated member on relative pivotal movement between the pivot shoe and cylinder cam for locking the pivot shoe and cylinder cam in a selected position longitudinally of the elongated hollow member.

11. Structure as set forth in claim 10, wherein the structure operable between the cylinder cam and pivot shoe includes engaged resilient portions whereby the pivot shoe is resiliently urged into locking engagement with the rear wall and front flanges of the jamb member on pivoting of the pivot shoe relative to the cylinder cam with a predetermined substantially constant force over a substantial pivot angle.

12. Structure as set forth in claim 10, wherein the cylinder cam includes a non-cylindrical recess therein and further including actuating means for the guide and lock structure comprising a non-cylindrical shaft one end of which is inserted in the non-cylindrical recess in the cylinder cam and means at the other end of the non-cylindrical shaft for securing the non-cylindrical shaft to a window sash.

13. Pivoted sash window structure comprising at least one jamb member having a hollow, generally rectangular cross section including side walls, a rear wall and a front wall, a slot extending longitudinally of the front wall of the jamb member producing front wall flanges on either side of the slot, a pivot shoe positioned within the jamb member for reciprocal movement axially thereof including a generally rectangular body portion, a body portion upper part, means for securing a sash balance to the upper part of the pivot shoe body portion including a member adapted to extend transversely thereof and received thereby, a sash balance engaged at one end with the transversely extending member and at the other end with the jamb member, said body portion of the pivot shoe having a lower part including an opening extending therethrough substantially perpendicularly of the jamb member and aligned with the slot therein, resilient tab portions extending from the body portion of the pivot shoe downwardly toward the opening therethrough terminating in cam parts extending toward the body portion of the pivot shoe, a cylinder cam having a cylindrical shank with an axially extending non-cylindrical opening in one end thereof extending through the opening in the pivot shoe, a head on the other end of the cylinder cam shank extending radially outwardly from the shank having opposed notches in the periphery thereof whereby with the cylinder cam in one relative pivoted position with respect to the pivot shoe the cylinder cam may be moved axially of the shank thereof toward the pivot shoe to position the head of the cylinder cam between the lower part of the body portion and the tab portions of the pivot shoe on rotation of the cylinder cam 180° with respect to the pivot shoe, a window sash positioned adjacent the jamb member for pivotal movement relative thereto, and an actuating member including a non-circular shaft portion one end of which extends within the non-circular opening in the cylinder cam and means at the other end of the shaft portion of the actuating member for securing the actuating member to the window sash whereby on pivoting of the window sash relative to the jamb member the cylinder cam is pivoted relative to the pivot shoe to cam the head of the cylinder cam between the tab and body portions thereof and expand the pivot shoe whereby the body portion of the pivot shoe is urged into engagement with the rear wall of the jamb member and the tab portions of the pivot shoe are urged into engagement with the front flanges of the jamb member to resiliently lock the jamb member into a predetermined position axially of the jamb member.

14. Pivoted sash window structure comprising at least one jamb member having a hollow, generally rectangular cross section including side walls, a rear wall and a front wall, a slot extending longitudinally of the front wall of the jamb member producing front wall flanges on either side of the slot, a pivot shoe positioned within the jamb member for reciprocal movement axially thereof including a generally rectangular body portion having guide pads at the four corners thereof, a body portion upper part, means for securing a sash balance to the upper part of the pivot shoe body portion including a pin adapted to extend transversely thereof and received thereby, a sash balance secured at one end to the pin and at the other end to the jamb member, said body portion of the pivot shoe having a lower part including an opening extending therethrough substantially perpendicularly of the jamb member and aligned with the slot therein, a ring around the rear end of the opening through the pivot shoe, and resilient tab portions extending centrally from the body portion of the pivot shoe downwardly toward the opening therethrough terminating in cam parts extending toward the body portion of the pivot shoe, a cylinder cam having a cylindrical shank with an axially extending non-cylindrical opening in one end thereof extending through the opening in the pivot shoe, a substantially flat resilient head on the other end of the cylinder cam shank extending radially outwardly from the shank having opposed notches in the periphery thereof whereby with the cylinder cam in one relative pivoted position with respect to the pivot shoe the cylinder cam may be moved axially of the shank thereof toward the pivot shoe to position the head of the cylinder cam between the body portion and the tab portions of the pivot shoe on rotation of the cylinder cam 180° with respect to the pivot shoe, a window sash positioned adjacent the jamb member for pivotal movement relative thereto, and an actuating member including a non-circular shaft portion one end of which extends within the non-circular opening in the cylinder cam and means at the other end of the shaft portion of the actuating member for securing the actuating member to the window sash whereby on pivoting of the window sash relative to the jamb member the cylinder cam is pivoted relative to the pivot shoe to cam the head of the cylinder cam between the tab and body portions thereof and expand the pivot shoe whereby the body portion of the pivot shoe is urged into engagement with the rear wall of the jamb member and the tab portions of the pivot shoe are urged into engagement with the front flanges of the jamb member to resiliently lock the jamb member into a predetermined position axially of the jamb member.

* * * * *